US006435074B1

(12) United States Patent
Tanaka et al.

(10) Patent No.: US 6,435,074 B1
(45) Date of Patent: Aug. 20, 2002

(54) BEARING DEVICE FOR SWASH PLATE TYPE COMPRESSORS

(75) Inventors: Tadahisa Tanaka, Iwata; Toshikatsu Miyaji, Sano; Masaki Kawachi, Ashikaga, all of (JP)

(73) Assignee: NTN Corporation, Tokyo-to (JP)

( * ) Notice: Subject to any disclaimer, the term of this patent is extended or adjusted under 35 U.S.C. 154(b) by 0 days.

(21) Appl. No.: 09/440,287

(22) Filed: Nov. 15, 1999

(30) Foreign Application Priority Data

Dec. 10, 1998 (JP) ..... 10-351639

(51) Int. Cl.[7] ..... B21K 1/76; B21J 5/02
(52) U.S. Cl. ..... 92/72; 92/129
(58) Field of Search ..... 92/12, 2, 71, 129; 91/499; 417/269

(56) References Cited

U.S. PATENT DOCUMENTS 4,617,856 A * 10/1986 Miller et al. ..... 92/71
4,662,267 A * 5/1987 Kaku et al. ..... 92/71
4,683,803 A * 8/1987 Miller et al. ..... 92/71
4,734,014 A * 3/1988 Ikeda et al. ..... 417/269
6,024,010 A 2/2000 Kato et al. ..... 92/71
6,168,389 B1 * 1/2001 Fukushima ..... 417/269

FOREIGN PATENT DOCUMENTS

DE 198 30 228 A1 2/1999
EP 0 919 719 A3 6/1999
EP 0 919 719 A2 6/1999

* cited by examiner

*Primary Examiner*—John E. Ryznic
(74) *Attorney, Agent, or Firm*—Arent Fox Kintner Plotkin & Kahn

(57) ABSTRACT

In a swash plate type compressor comprising a piston 4 slidably received in a cylinder bore disposed parallel with the driving shaft and a swash plate 2 obliquely attached to the driving shaft and engaged by the piston 4 through a bearing device, the bearing device comprises a spherical seat 4*b* composed of a single concave surface formed in the piston 4, and a substantially hemispherical shoe 10 contacting the spherical seat 4*b*, the outer peripheral surface of the shoe 10 being composed of a skirt portion 12, a top portion 16 having a larger radius of curvature, $R_2$, than that R of the spherical seat 4*b*, and a transition portion 14 contacting the spherical seat 4*b* between the skirt portion 12 and the top portion 16 and having a smaller radius of curvature, $R_3$, than that R of the spherical seat 4*b*.

5 Claims, 5 Drawing Sheets

BEARING DEVICE FOR SWASH PLATE TYPE COMPRESSORS

BACKGROUND OF THE INVENTION

1. Field of the Invention

This invention relates to a swash plate type compressor used for automobile air conditioners, and more particularly it relates to a bearing device including a substantially hemispherical shoe interposed between the swash plate and piston of a swash plate type compressor so as to convert the rotary motion of the swash plate into the reciprocating motion of the piston.

Swash plate type compressors are of two types, one in which the angle of inclination of the swash plate with respect to the driving shaft is fixed, and the other, or the variable volume type, in which the angle of inclination of the swash plate with respect to the driving shaft is variable, to thereby vary the piston stroke. Further, in another aspect they are classified into two types, the single-acting type in which the delivery stroke is executed only when the piston is moved in one direction, and the double-acting type using a double-headed piston. As far as the piston-cylinder mechanism and the bearing section are concerned, these types are of the same basic construction.

2. Description of the Prior Art

A swash plate type compressor, as FIG. 4 shows its schematic arrangement, has a driving shaft 3 having a swash plate 2 obliquely attached thereto, the driving shaft 3 being rotatably supported in a cylinder block 5. The cylinder block 5 is formed with a plurality of cylinder bores 6 extending parallel with the driving shaft 3 and disposed circumferentially at equal intervals, each cylinder bore 6 having a piston 4 slidably fitted therein. The piston 4 has at one end a recess 4*a* formed therein to straddle the outer periphery of the swash plate 2, and spherical seats 4*b* are formed in the axially opposed surfaces of the recess 4*a*. A shoe 1 is incorporated in each spherical seat 4*b* such that it is interposed between the swash plate 2 and the piston 4. And the shoe 1 and the spherical seat 4*b* cooperate with each other to provide a bearing section A for converting the rotary motion of the swash plate into the reciprocating motion of the piston 4. That is, when the swash plate 2 is rotated with the driving shaft 3, the rotary motion of the swash plate 2 is converted into the reciprocating motion of the piston 4 by the action of the bearing section A. At this time, the shoe 1 performs a slide movement in one direction with respect to the swash plate 2 while with respect to the spherical seat 4*b* it performs a swing slide movement over a given angle.

There has heretofore been known an arrangement wherein, as shown in FIGS. 5A and 5B, of the convex spherical outer surface of the shoe 1, the contact portion and skirt portion which contact the spherical seat 4*b* are formed with different curvatures (see Japanese Patent Publication Heisei 3-51912). FIGS. 5A and 5B show the shoe 1 incorporated in the spherical seat 4*b* of the piston 4. The spherical seat 4*b* is formed using a single radius of curvature. On the other hand, the outer peripheral surface of the shoe 1 is composed of a reference spherical surface 1*a* at the top having substantially the same radius of curvature as the spherical seat 4*b*, and a skirt spherical surface 1*b* resulting from the skirt portion, which undergoes repetitive engagement and disengagement with and from the spherical seat 4*b*, receding from the reference spherical surface 1*a* toward the center of the shoe 1. In other words, not only does the curvature of the skirt spherical surface 1*b* differ from that of the reference spherical surface 1*a* but also the curvatures of other portions gradually vary. Thereby, the clearance which gently increases from the boundary between the reference spherical surface 1*a* and the skirt spherical surface 1*b* will vary in size as the shoe 1 swings, assisting in wedge action to effectively feed lubricating oil to the contact region of the reference spherical surface 1*a* which is sliding.

In the swash plate type compressor, the shoe is forced to perform the so-called precessional movement attending on the rotary movement of the swash plate, tending to suffer local abutment which, in turn, causes drawbacks including local wear. Therefore, to secure accurate abutment for the shoe, it is necessary to conduct management, in the process of producing such shoes, so as to ensure that the position of the abutment falls within a predetermined range. If, however, the outer peripheral surface of the shoe which contacts the spherical seat of the piston is a spherical surface having substantially the same radius of curvature as the spherical seat, the position of the abutment is not regular but tends to vary. Furthermore, the position of the abutment of the shoe against the spherical seat depends on the quality of finish of the spherical surface of the shoe, making it difficult to manage the height of the shoe, i. e., to manage the clearance between the shoe and the swash plate.

SUMMARY OF THE INVENTION

Accordingly, an object of this invention is to make it possible to provide a simple arrangement adapted to avoid contact between the top of a shoe and the spherical seat of a piston and secure a suitable contact area even if the angle of inclination of the swash plate is increased, thereby providing satisfactory lubrication.

A bearing device for swash plate type compressors according to the invention is characterized in that in a swash plate type compressor including a piston slidably received in a cylinder bore extending parallel with the driving shaft, the piston engaging the swash plate through a bearing device which swash plate is obliquely attached to the driving shaft, the rotation of the swash plate reciprocating the piston in the cylinder bore, the bearing device comprises a spherical seat composed of a single concave surface formed in the piston, and a substantially hemispherical shoe contacting the spherical seat, the outer peripheral surface of the shoe being composed of a skirt portion, a top portion having a larger radius of curvature than that of the spherical seat, and a transition portion positioned between the skirt portion and the top portion, having a smaller radius of curvature than that of the spherical seat, and contacting the latter. Making the radius of curvature of the top portion larger than that of the spherical seat ensures that even if there is a variation in the size of the outer peripheral surface of the shoe or the size of the spherical seat, there is no possibility of the top portion contacting the spherical seat; therefore, a suitable clearance is maintained between them to hold lubricating oil therein. Further, the transition portion between the skirt portion and the top portion is a portion which joins the skirt portion and the top portion, and the skirt portion and the top portion do not contact the spherical seat. The shoe contacts the spherical seat always at the transition portion.

The radius of curvature of the skirt portion of the shoe may advantageously be slightly smaller than that of the spherical seat. Making the radius of curvature of the skirt portion slightly smaller than that of the spherical seat forms a suitable clearance between the skirt portion and the spherical seat. Therefore, it is possible to prevent the edge of the corner of the spherical seat from abutting against the shoe, and to ensure satisfactory drawing of lubricating oil into the space between the shoe and the spherical seat.

The center of curvature of the skirt portion of the shoe may advantageously be located across the centerline of the shoe and radially spaced a predetermined distance from the centerline. In this case, since the outer peripheral surface of the shoe contacts the spherical seat always at the transition portion, the point at which the shoe abuts against the spherical seat can be accurately set. Further, a clearance can be formed between the skirt portion and the spherical seat by equalizing the radius of curvature of the skirt portion with the radius of curvature of the spherical seat or even by slightly decreasing it. it is preferable that the radius of curvature of the top portion of the shoe be set within the range of about 1.5–2.0 times the radius of curvature of the spherical seat. Making the radius of curvature of the top portion larger than that of the spherical seat makes it possible to avoid contact between the top portion of the shoe and the spherical seat of the piston, so that a suitable clearance is maintained between them to hold lubricating oil therein, as described above. If, however, the radius of curvature of the top portion exceeded twice the radius of curvature of the spherical seat, the smooth joint between the top portion and the transition portion would not be obtained and the smoothness with which the transition portion contacted the spherical seat would be impaired. Further, to exemplify the radius of curvature of the transition portion of the shoe in this case, it may be ⅓–⅔ times as large as the radius of curvature of the top portion.

DESCRIPTION OF THE PREFERRED EMBODIMENTS

Figure 1:
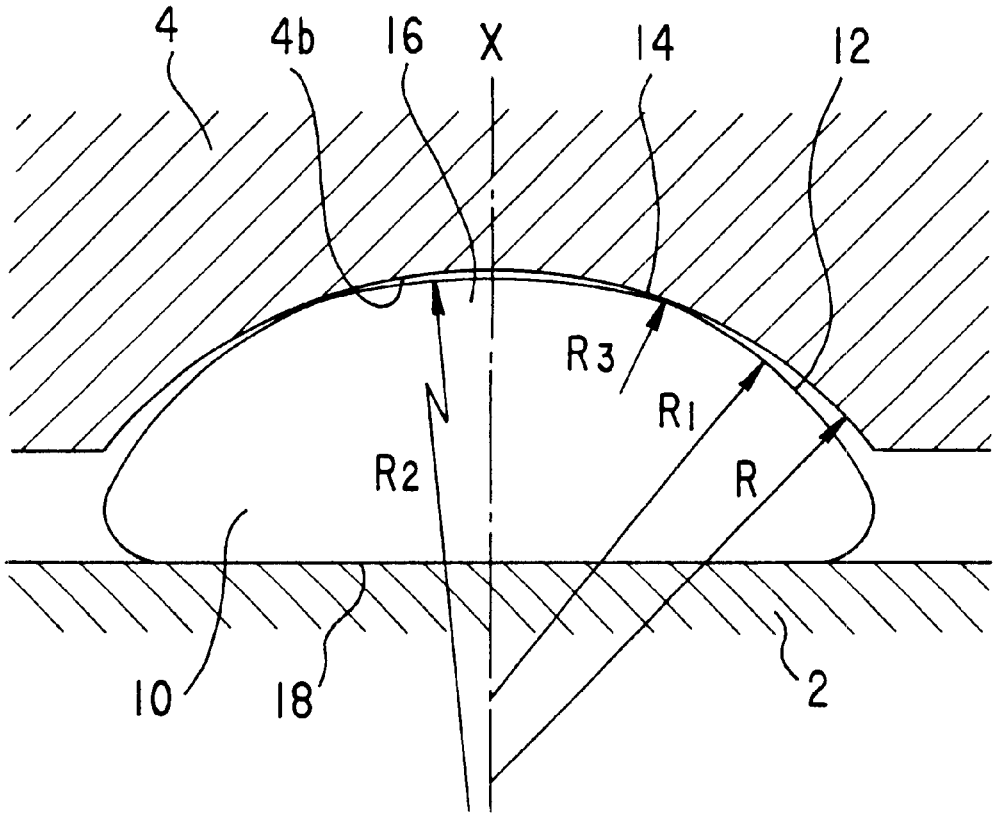
FIG. 1 is a longitudinal section showing an embodiment of the invention.

FIG. 1 shows a shoe 10 incorporated between a awash plate 2 and a piston 4. As already described, the shoe 10 and the spherical seat 4*b* constitute a bearing device wherein as the swash plate 2 is rotated, the rotary motion of the swash plate 2 is converted into the reciprocating motion of the piston 4 by the action of the bearing device.

The shoe 10 is formed of a steel ball by pressing and has a substantially hemispherical appearance, as shown. The shoe 10 is in contact at its bottom surface 18 with the swash plate 2 on the one hand and on the other hand at its substantially spherical outer surface with the spherical seat 4*b* of the piston 4. The bottom surface 18 is flat and smoothly connects with the outer peripheral surface through a curved surface of relatively large curvature. In addition, the bottom surface 18 is not necessarily a flat surface perpendicular to the centerline X, and it may, for example, be a convex surface of large curvature or a crown having a central region gently raised with respect to the peripheral region; however, a flat surface is advantageous in that it is easier to process.

The outer peripheral surface of the shoe 10 is composed of a combination of partial spherical surfaces, such as a skirt portion 12, a transient portion 14 and a top portion 16 in the order mentioned as seen from below in FIG. 1. The skirt portion 12 is a partial spherical surface having a radius of curvature, $R_1$, which is slightly smaller than that R of the spherical seat 4*b*, the skirt portion 12 smoothly connecting with the bottom surface 18. Making radius of curvature, $R_1$, of the skirt portion 12 slightly smaller than that R of the spherical seat 4*b* forms a suitable amount of clearance between the skirt portion 12 and the spherical seat 4*b*. Therefore, it is possible to prevent the edge of the corner of the spherical seat 4*b* from abutting against the shoe 10, and to ensure satisfactory drawing of lubricating oil into the space between the shoe 10 and the spherical seat 4*b*.

The top portion 16 is a partial spherical surface having a larger radius of curvature, $R_2$, than that of the skirt portion 12 and the transition portion 14. The radius of curvature, $R_2$, of the top portion 16 is set within the range of about 1.5–2.0 times the radius of curvature, R, of the spherical seat 4*b*. Making the radius of curvature, $R_2$, of the top portion 16 larger than that R of the spherical seat 4*b* ensures that even if there is a variation in the size of the outer peripheral surface of the shoe 10 or the size of the spherical seat 4*b*, there is no possibility of the top portion 16 contacting the spherical seat 4*b*; therefore, a suitable clearance is maintained between them to hold lubricating oil therein. If, however, the radius of curvature, $R_2$, of the top portion 16 is made excessively large, the joint between the top portion 16 and the transition portion 14 is bent to form an angle, and the contact between the transition portion 14 and the spherical seat 4*b* tends to impair its smoothness, and this tendency becomes more pronounced if the wear of the transition portion 14 grows. Therefore, this leads to insufficiency in lubrication for the transition portion 14, constituting a factor in reduced service life. Further, in the manufacturing process, the more excessively the top portion R is made large, the more difficult it is to effect single-step forming by using a metal mold, so that two steps have to be employed or if a single step is employed, this will lead to decreasing the service life of the metal mold. In this respect, the upper limit of the radius of curvature, $R_2$, of the top portion 16 is established.

The transition portion 14 is a partial spherical surface positioned between the skirt portion 12 and the top portion 16, and smoothly connecting therewith. In other words, the transition portion 14 is a portion which joins the skirt portion 12 and the top portion 16, and in this sense, the radius of curvature, $R_3$, of the transition portion 14 will be referred to as "joint rounding". This joint rounding $R_3$ is set, for example, at about ⅓–⅔ of the radius of curvature, $R_2$, of the top portion 16. As described above, the skirt portion 12 and the top portion 16 do not contact the spherical seat 4*b*, and the shoe 10 contacts the spherical seat 4*b* at the transition portion 14. That is, the abutment of the shoe 10 against the spherical seat 4*b* occurs always at the transition portion 14.

Figure 2:
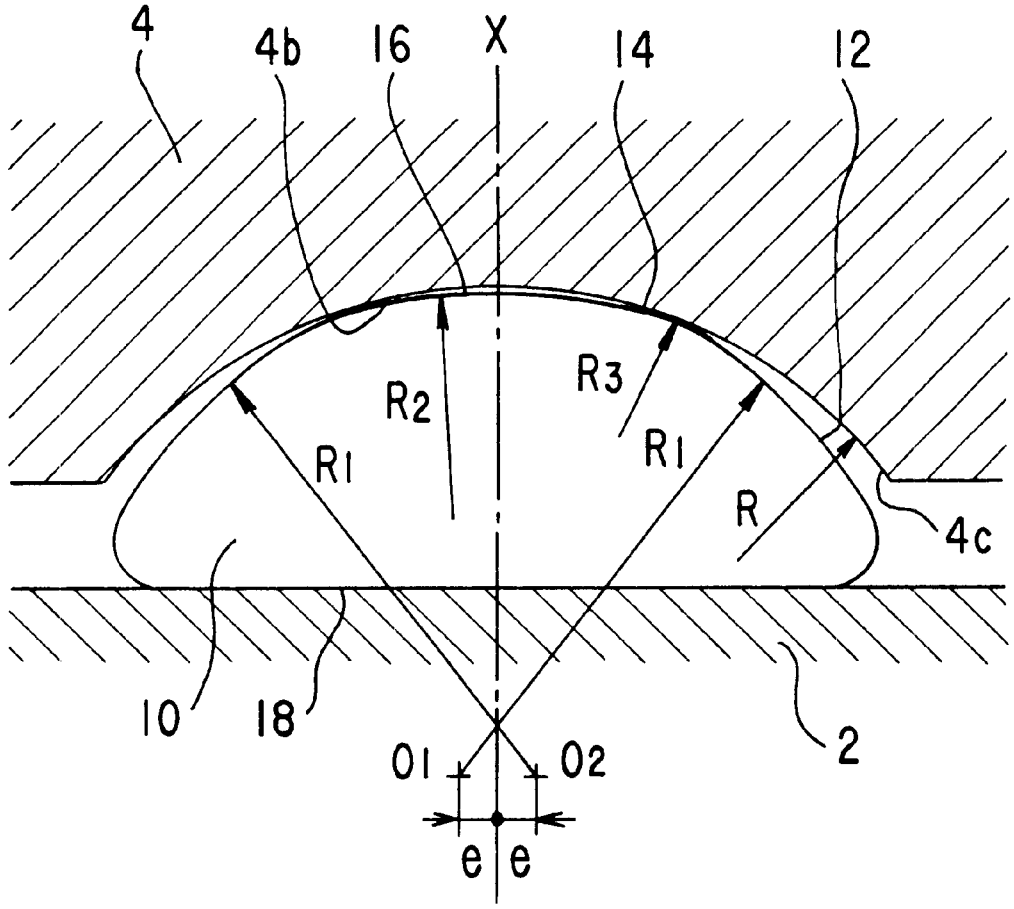
FIG. 2 is a longitudinal section showing another embodiment of the invention.

Further, an embodiment shown in FIG. 2 is the same as the above embodiment shown in FIG. 1 in that the outer peripheral surface of the shoe 10 is composed of the skirt portion 12, transition portion 14 and top portion 16 but the arrangement of the skirt portion 12 differs as follows: The skirt portion 12 is formed of a curved surface having as a generatrix an arc whose center of curvature is located across the centerline X of the shoe 10 and is radially spaced a predetermined distance from the centerline X. In other words, the centers of curvature $O_1$, and $O_2$ are offset in opposite directions across the centerline X (or they are cross-offset), the amount of offset being denoted by e. In this case, the outer peripheral surface of the shoe 10 contacts the spherical seat 4*b* always at two transition portions 14 as seen in a longitudinal section. Therefore, the point at which the shoe 10 abuts against the spherical seat 4*b* can be accurately set. Further, a clearance can be formed between the skirt portion and the spherical seat by equalizing the radius of curvature, $R_1$, of the skirt portion 12 with the radius of curvature, R, of the spherical seat 4*b* or even by slightly decreasing it.

If the center of curvature of the skirt portion 12 is cross-offset so as to secure a predetermined amount of clearance between the skirt portion 12 and the opening portion 4*c* of the spherical seat 4*b*, then the radius of curvature, $R_1$, of the skirt portion 12 becomes larger by the amount of offset e than in the case of FIG. 1 having no offset, thus becoming more nearly equal to the radius of curvature, R, of the spherical seat 4*b* than in the case of FIG. 1. On the other hand, if a predetermined amount of clearance is secured at a point spaced a predetermined angle from the transition portion 14, the change in the R toward the exit of the spherical seat 4*b* decreases and so does the clearance at the opening portion 4*c* of the spherical seat 4*b*; therefore, when the angle changes as the swash plate 2 rotates between the skirt portion 12 and the spherical seat 4*b*, it is possible to prevent the shoe 10 from making an uncontrolled movement, so that stabilized operation can be secured. Thus, cross-offsetting increases the degree of freedom of design.

Figure 3A:
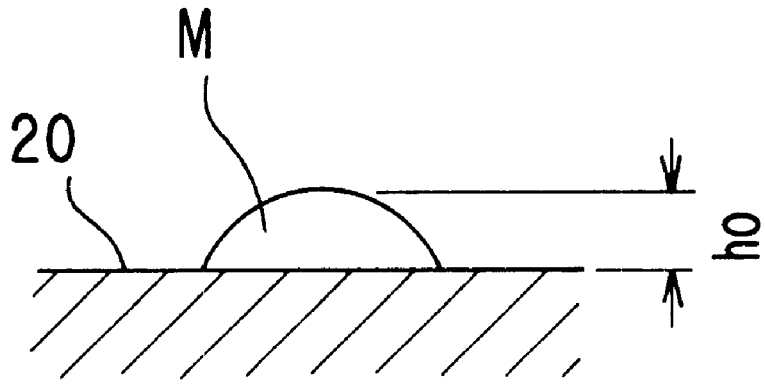
FIG. 3A is a side view of a master piece.
Figure 3B:
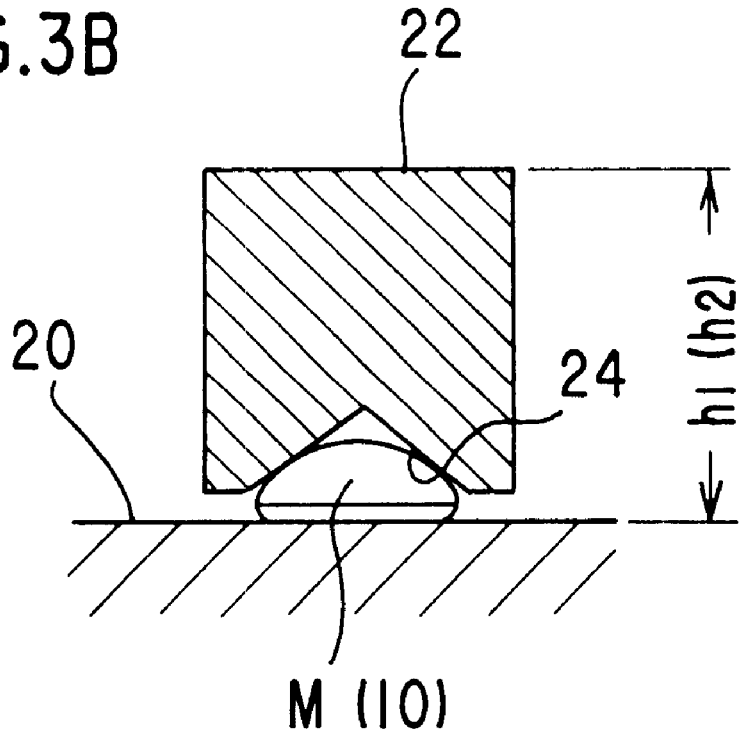
FIG. 3B is a sectional view for explaining a measuring method.
Figure 4:
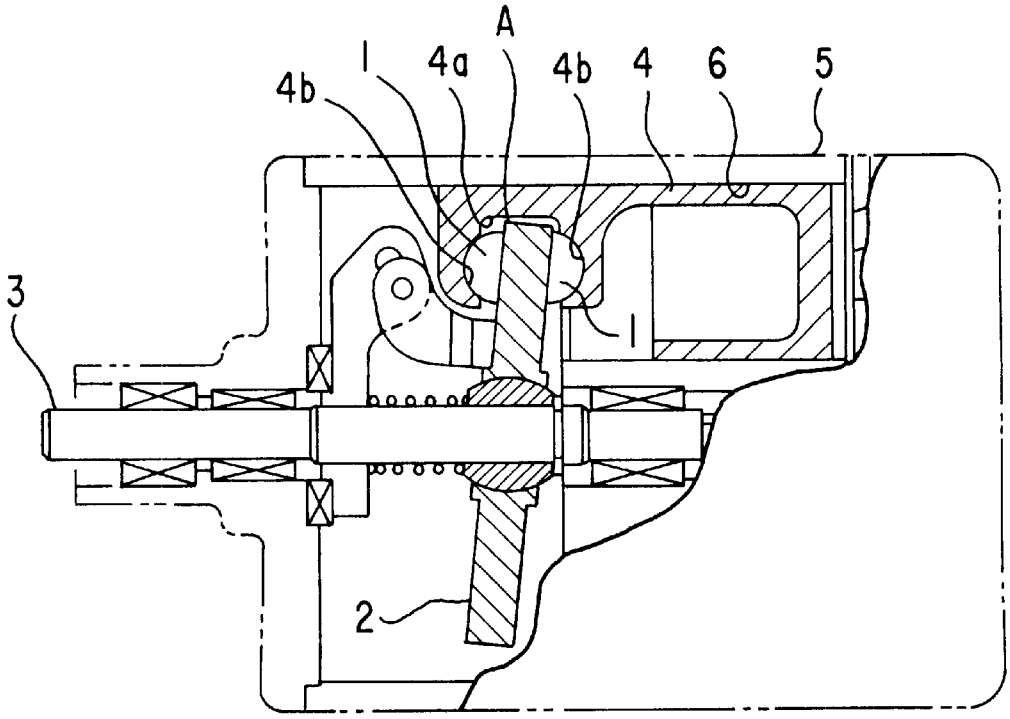
FIG. 4 is a longitudinal section showing the schematic arrangement of a variable volume type awash plate compressor.
Figure 5B:
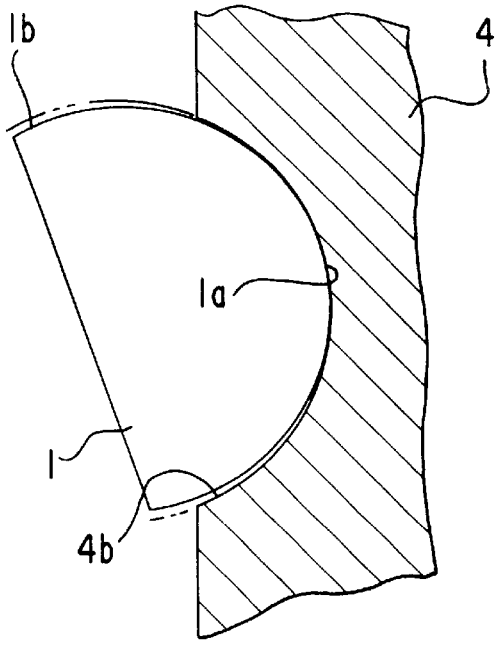
FIG. 5B is a longitudinal section similar to FIG. 5A, showing the shoe inclined with respect to the spherical seat.
Figure 5A:
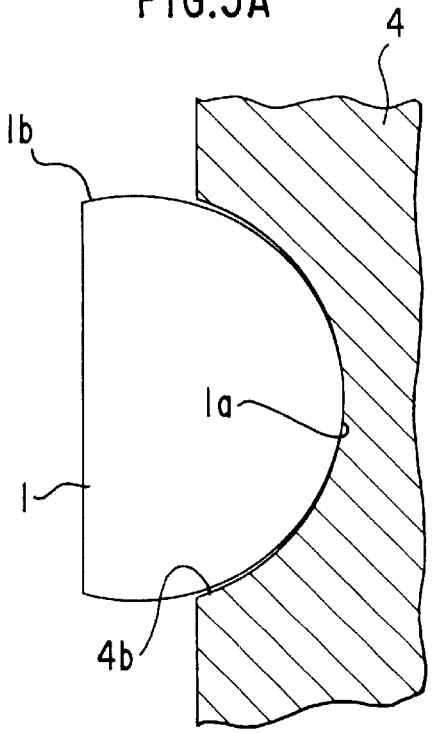
FIG. 5A is a longitudinal section showing the prior art, showing a shoe coaxial with a spherical seat.

The management of the abutment of the shoe 10 is effected on the basis of the height of the shoe obtained in the manner as follows. As shown in FIGS. 3A and 3B, a master piece M finished to a predetermined curvature and a height $h_0$ is placed on a surface plate 20 and a jig 22 having a recess 24 in the form of a cone having a predetermined cone angle is placed on the master piece, and the distance (master height $h_1$) from the surface plate 20 to the upper surface of the jig 22 is measured. Then, the shoe 10 to be measured is placed on the surface plate 20 and the jig 22 is placed thereon, and the distance (shoe assembly height $h_2$) from the surface plate 20 to the upper surface of the jig 22 is measured. And the height H of the shoe 10 to be found is calculated from the following formula.

$$H=h_0+(h_2-h_1)$$

By controlling the height H of the shoe such that it comes within a predetermined range, it is possible to secure a predetermined abutment and a bearing clearance.

In addition, a description has been given herein by exemplifying a single acting type piston; however, the invention is also applicable to the double acting type having a double-headed piston. The invention is applicable not only to the variable volume type but also to the fixed swash plate type compressor.

As has been described so far, according to the invention, it is possible to provide a simple arrangement adapted to avoid contact between the top of a shoe and the spherical seat of a piston and secure a suitable contact area even if the angle of inclination of the swash plate is increased, thereby providing satisfactory lubrication.

What is claimed is:

1. In a swash plate type compressor including a piston slidably received in a cylinder bore extending parallel with the driving shaft, said piston engaging the swash plate through a bearing device which swash plate is obliquely attached to the driving shaft, the rotation of the swash plate reciprocating the piston in the cylinder bore, improvements in said bearing device characterized in that said bearing device comprises a spherical seat composed of a single concave surface formed in said piston, and a substantially hemispherical shoe contacting said spherical seat, the outer peripheral surface of said she being composed of a skirt portion, a top portion having a larger finite radius of curvature than that of the spherical seat, and a transitional portion positioned between the skirt portion and the top portion, having a smaller finite radius of curvature than that of the spherical seat, sand contacting the latter.

2. A bearing device for swash plate type compressors as described in claim 1, characterized in that the radius of curvature of the skirt portion of the shoe is slightly smaller than that of the spherical seat.

3. A bearing device for swash plate type compressors as described in claim 1, characterized in that the center of curvature of the skirt portion of the shoe is located across the centerline of the shoe and is radially spaced a predetermined distance from the centerline.

4. A bearing device for swash plate type compressor including a piston slidably received in a cylinder bore extending parallel with the driving shaft, said piston engaging the swash plate through a bearing device which swash plate is obliquely attached to the driving shaft, the rotation of the swash plate reciprocating the piston in the cylinder bore, said bearing device comprising a spherical seat composed of a single concave surface formed in said piston, and a substantially hemispherical shoe contacting said spherical seat, the outer peripheral surface of said she being composed of a skirt portion, a top portion having a larger radius of curvature than that of the spherical seat, and a transitional portion positioned between the skirt portion and the top portion, having a smaller radius of curvature than that of the spherical seat, sand contacting the latter, characterized in that the radius of curvature of the top portion of the shoe is about 1.5–2.0 times as large as the radius of curvature of the spherical seat.

5. A bearing device for swash plate type compressor as described in claim 4, characterized in that the radius of curvature of the transition portion of the shoe is ⅓–⅔ times as large as the radius of curvature of the top portion.

* * * * *

UNITED STATES PATENT AND TRADEMARK OFFICE

CERTIFICATE OF CORRECTION

PATENT NO. : 6,435,074 B1
DATED : August 20, 2002
INVENTOR(S) : Tanaka et al.

It is certified that error appears in the above-identified patent and that said Letters Patent is hereby corrected as shown below:

Title page,
Item [73], Assignee, please add, as the second assignee: -- Calsonic Kansei Corporation, Tokyo-to, (JP). --

Signed and Sealed this

Fifteenth Day of April, 2003

JAMES E. ROGAN
*Director of the United States Patent and Trademark Office*